United States Patent [19]

Eckert et al.

[11] 4,117,642

[45] Oct. 3, 1978

[54] CEILING PANEL ATTACHMENT CLIP

[75] Inventors: Lewis W. Eckert, Lancaster; Harold W. Nikolaus, Columbia; James C. Ollinger, Lancaster, all of Pa.

[73] Assignee: Armstrong Cork Company, Lancaster, Pa.

[21] Appl. No.: 820,047

[22] Filed: Jul. 29, 1977

[51] Int. Cl.[2] ..... E04B 5/57; E04D 1/34

[52] U.S. Cl. ..... 52/486; 52/489

[58] Field of Search ..... 52/489, 483, 357–359, 52/486, 360, 492, 520, 539, 144, 145

[56] References Cited

U.S. PATENT DOCUMENTS

| | | | |
|---|---|---|---|
| 1,974,259 | 9/1934 | Cherry | 52/492 |
| 1,997,939 | 4/1935 | Loucks | 52/489 |
| 2,004,917 | 6/1935 | Johnson | 52/492 |
| 3,025,650 | 3/1962 | Nelsson | 52/489 |
| 3,713,264 | 1/1973 | Morgan | 52/489 |

*Primary Examiner*—James L. Ridgill, Jr.

[57] ABSTRACT

The invention is directed to a clip structure for fastening a specific type of ceiling panel to a specific type of support structure. Both the support structure and ceiling panel have flanges and the clip spans the two flanges to fasten them together.

3 Claims, 2 Drawing Figures

CEILING PANEL ATTACHMENT CLIP

BACKGROUND OF THE INVENTION

1. Field of the Invention

The invention is directed to a suspended ceiling system and, more particularly, to a clip for fastening together elements of a suspended ceiling system.

2. Description of the Prior Art

U.S. Pat. Nos. 2,811,036 and 2,921,464 disclose that it is not novel to provide clip structures for fastening together elements of a suspended ceiling system.

The invention herein is directed to a specific type of clip fastening together a support structure and ceiling panel of a specific configuration.

SUMMARY OF THE INVENTION

The invention is directed to a suspended ceiling construction which utilizes a support channel having a generally inverted U-shape. The support channel is fastened to the structural ceiling of a room. The support channel has two flanges extending horizontally, one disposed on each side of the support channel. A ceiling panel is utilized in conjunction with the support channel. The back surface of the ceiling panel engages the support channel and actually rests against the flanges of the support channel. The ceiling panel has a flange which rests up against the flanges of the support channel. A clip means engages the flange of the support channel and the flange of the ceiling panel to hold these two flanges together. The clip may actually span both flanges of the support channel and can have a narrow or wide configuration which will permit it to contact a narrow or wide portion of the flange of the ceiling panel.

DESCRIPTION OF THE PREFERRED EMBODIMENTS

Figure 1:
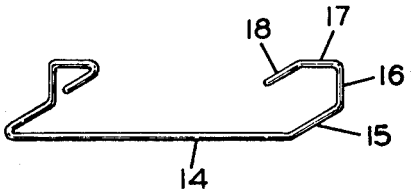
FIG. 1 is a perspective view of the one example of a clip structure.

The ceiling construction herein is composed of three major components. The first component is the support channel 1. The second component is the ceiling panel 2, and the third component is the clip means 3.

The support channel 1 is of a generally inverted U-shaped configuration having a base 4 and two side legs 5 and 6 formed into a U-shaped configuration. The base 4 will normally be fastened to the overlying structural ceiling of a room. Flanges 7 and 8 are provided on each side of the support channel, and these are generally disposed in a horizontal plane. The support channel could also be formed as a standard inverted T channel.

Figure 2:
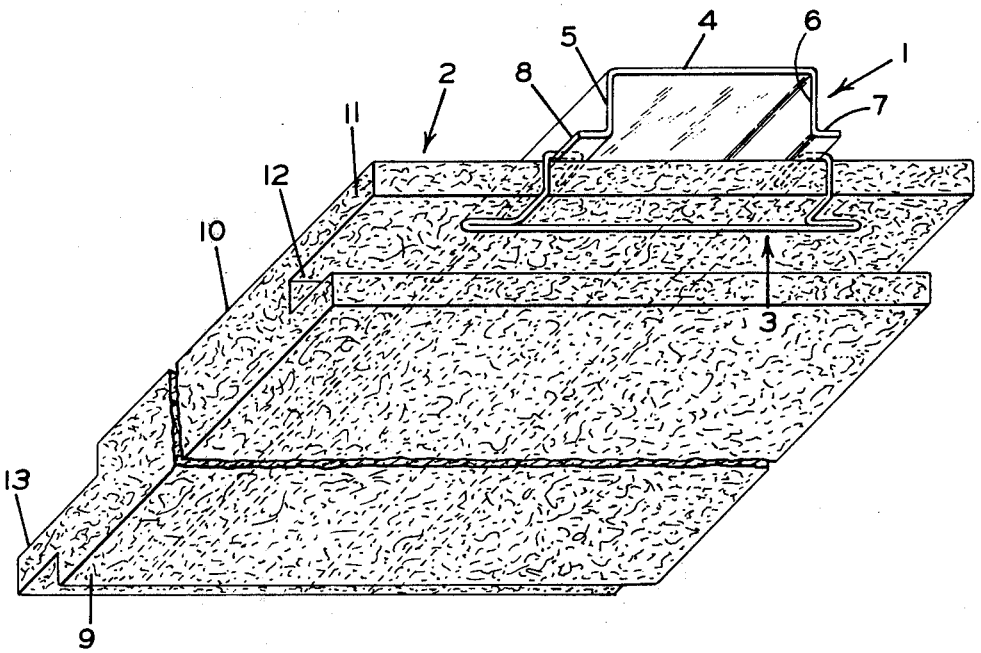
FIG. 2 is a perspective view of another embodiment of the clip structure being used in conjunction with the support channel and ceiling panel.

The ceiling panel is generally a conventional tongue and groove ceiling tile. This means that the structure has at least two interacting end configurations, such as shown in FIG. 2. The panel has a front surface 9 and a back surface 10. A flange 11 projects from the back surface 10, and it is of a thickness less than the thickness of the ceiling tile measured from surface 9 to surface 10. There is normally provided a recess 12 adjacent flange 11. The other end of the ceiling panel has a flange 13, which coacts with recess 12 to lock together the two ceiling tiles. Normally the ceiling tile is held in position by passing staples through the flange 11 and running the staples into furring strips on the overlying ceiling structure. The flange 13 is positioned near the front face of the ceiling tile. The ceiling tile is a conventional fibrous ceiling panel which is normally an acoustical type ceiling panel in that it helps with the sound absorption of noise within a room. However, the invention need not be restricted to an acoustical type of ceiling panel. Also the invention need not be restricted to the conventional tongue and groove ceiling tile. It can be used with any type of ceiling panel as long as it has a flange on one side which can receive the below described clip structure and then have some type of structure on the opposite side which will overlie the flange and conceal the flange and clip means from view.

The third component of the ceiling construction is the clip means 3. The flange 11 of the ceiling tile is placed adjacent the flanges 8 and 9 of the channel support. The clip means then spans these two flanges 8 and/or 9 and 11 to hold these two flanges together and thus support the ceiling tile. The clip means could have either the configuration of FIG. 1 or the configuration of FIG. 2.

Basically, the clip means is composed of a body portion 14 which has two ends. Each end has a leg 15 extending perpendicular from the body portion. Then a leg 16 extends perpendicular from leg 15, with leg 16 in a plane extending perpendicular to the plane containing body portion 14 and leg 15. Another leg 17 then extends perpendicular from leg 16, and it is positioned in a plane parallel to the plane containing the body portion 14 and leg 15. Finally, there is a leg 18 extending perpendicular to leg 17, and it is located in the same plane containing the leg 17.

The leg 18 rests against the upper side of the flange 7 of the support channel. The legs 15 and 17 bend around the edge of the flange 7 of the support channel and the edge of the flange 11 of the ceiling tile so that leg 15 can move along the lower side of the flange 11. A similar type of configuration is provided on the other side of body portion 14 so that the clip means actually engages both flanges 7 and 8. The body portion 14 bears against the lower surface of the flange 11 and provides for substantial surface contact with the flange 11. In effect, the flanges 7, 8, and 11 are held together through a pincher action between leg 18 and body portion 14 which are connected together by legs 15, 16, and 17.

FIG. 2 shows a modified form for the clip means wherein the body portion 14 actually extends beyond the spacing between the two leg assemblies 15, 16, 17 and 18 so that the body portion engages a larger area of the flange 11. Because the flange 11 is part of a fibrous ceiling panel, it is possible that the body portion 14 of FIG. 1 would cut into the fibrous material flange 11. By making the body portion of a larger size as shown in FIG. 2, the pressure per unit area is reduced and there is a less of a tendency for the body portion 14 to cut into the fibrous material of the flange 11.

The support channel 1 is a metal channel, and the clip means 3 is made from spring steel. As was indicated above, the ceiling panel 2 is a conventional fibrous ceiling board and under normal circumstances would be the conventional tongue and groove ceiling tile sold in most lumberyards.

What is claimed is:

1. A ceiling construction comprising:

(a) at least one support channel fastened to the structural ceiling of a room, said support channel having two flanges horizontally disposed, one on each side of the support channel;

(b) an acoustical fibrous ceiling panel having a front and back surface, said back surface being positioned adjacent said support channel, at least two opposite edges of the panel having flanges projecting therefrom, one edge having its flange adjacent the back surface of the ceiling panel and the other opposite edge having its flange near the front surface of the ceiling panel, said flanges having a thickness less than the thickness of the ceiling panel as measured from the front to the back surfaces thereof;

(c) clip means engaging the flanges of the support channel and the flange of the ceiling panel adjacent the back surface thereof to fasten the ceiling panel to the support channel;

(d) the improvement comprising:

(1) forming the clip means from spring steel;

(2) said clip means having two ends, each end engaging one of said flanges of said support channels;

(3) said clip means having legs extending from its ends and bent around the flange of the ceiling panel; and (4) said clip means having a body portion bearing against the ceiling panel flange and connecting together said leg means.

2. A ceiling construction as set forth in claim 1 wherein said body member has a width equal to the spacing between the flanges of the support channel.

3. A ceiling construction as set forth in claim 1 wherein said body member has a width greater than the spacing between flanges of the support channel.

* * * * *